United States Patent [19]

Lesley

[11] Patent Number: 4,674,302

[45] Date of Patent: Jun. 23, 1987

[54] WARP KNITTING MACHINE

[75] Inventor: Bascum G. Lesley, Pickens, S.C.

[73] Assignee: Milliken Research Corporation, Spartanburg, S.C.

[21] Appl. No.: 271,634

[22] Filed: Jun. 8, 1981

[51] Int. Cl.[4] ..... D04B 27/02

[52] U.S. Cl. ..... 66/214

[58] Field of Search ..... 66/203, 207, 214

[56] References Cited

U.S. PATENT DOCUMENTS

| | | | |
|---|---|---|---|
| 2,682,163 | 6/1954 | Staff et al. | 66/109 X |
| 2,749,730 | 6/1956 | Noe | 60/109 X |
| 3,006,172 | 10/1961 | Porter | 66/109 |
| 3,046,764 | 7/1962 | Torrence | 66/214 |
| 3,857,260 | 12/1974 | Zwingenberger et al. | 60/109 |
| 4,051,698 | 10/1977 | Leohardt | 66/214 |
| 4,092,838 | 6/1978 | Gangi | 66/214 |
| 4,202,185 | 5/1980 | Lesley | 60/104 |
| 4,317,342 | 3/1982 | Kohl | 66/203 |
| 4,322,956 | 4/1982 | Wunner | 66/109 X |

FOREIGN PATENT DOCUMENTS

| | | | |
|---|---|---|---|
| 661298 | 4/1963 | Canada | 66/214 |

*Primary Examiner*—Ronald Feldbaum

*Attorney, Agent, or Firm*—Earle R. Marden; H. William Petry

[57] ABSTRACT

An improved warp knitting machine employing compound needles and an interconnected trick-sinker mechanism which maintains a fixed relationship with the knitting needles and tends to hold the knitted fabric in line with the back guide bar to lessen the stress on the knitting needles. Each of the guide bars include a hollow guide tube to guide the warp yarn to a point closely adjacent the top of the knitting needle to reduce the necessary vertical stroke of the knitting needles.

4 Claims, 8 Drawing Figures

WARP KNITTING MACHINE

The knitting speed of a knitting machine, the tendency to require considerable repair and the defects on the fabric being produced is partially dependent on the stroke of the knitting needles necessary to knit the yarn being supplied thereto.

Therefore it is an object of the invention to provide an improved knitting machine with a yarn guide system which reduces the required vertical stroke of the knitting needles.

Other objects and advantages of the invention will become readily apparent as the specification proceeds to describe the invention with reference to the accompanying drawings, in which.

Figure 1:
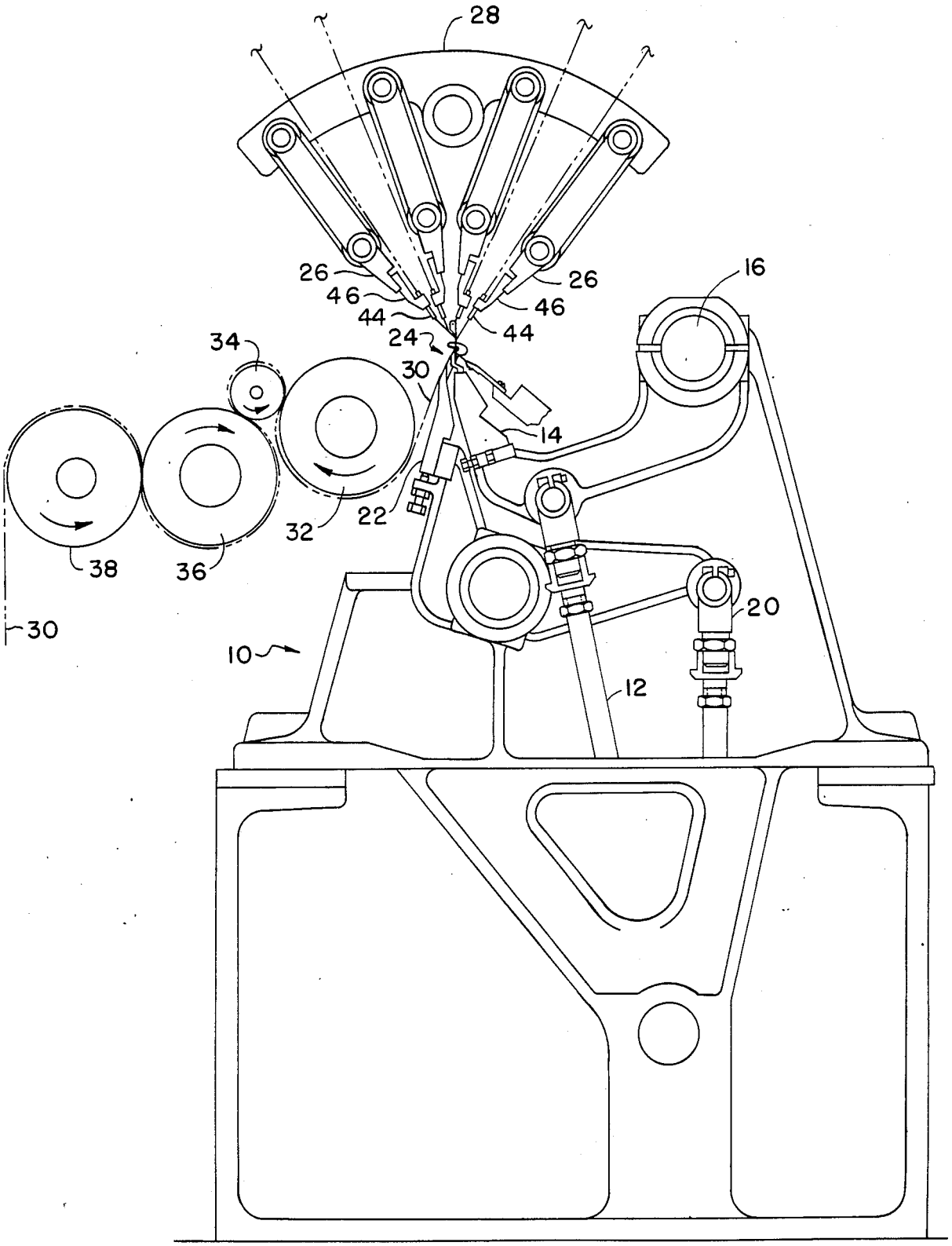
FIG. 1 represents a partially schematic side elevation view of the new, improved warp knitting machine.
Figure 2:
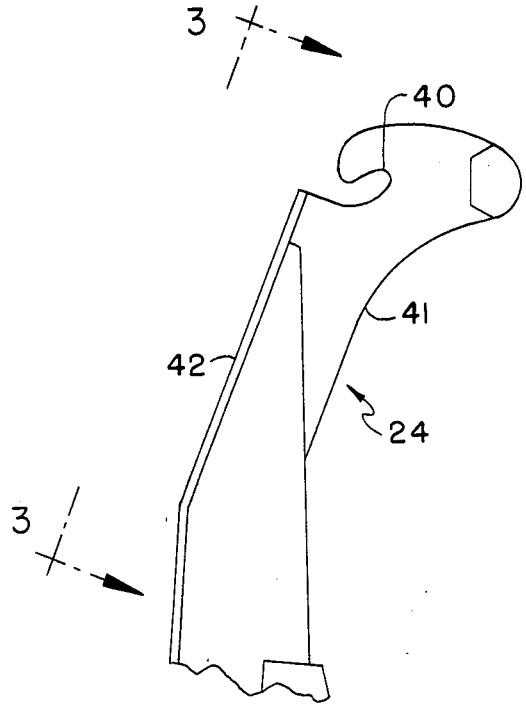
FIG. 2 is a side elevation view of the novel combination trick-sinker mechanism.
Figure 3:
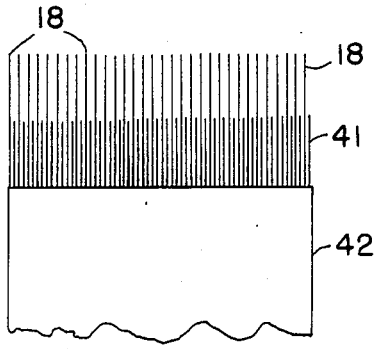
FIG. 3 is a view taken on line 3—3 of FIG. 2.
Figure 4:
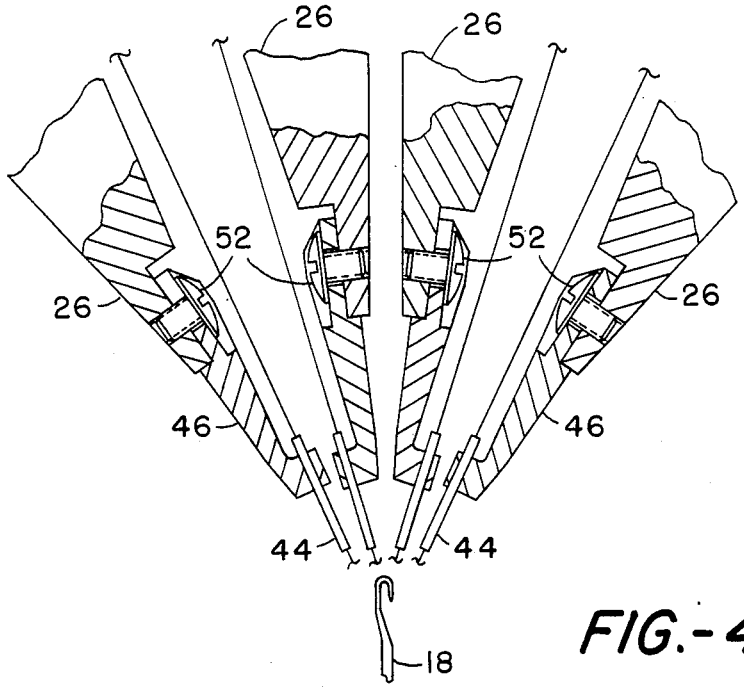
FIG. 4 is a blown-up view showing in detail the relationship of the guide bars and the knitting needle.

Looking now to FIG. 1, the reference numeral 10 represents the new and improved warp knitting machine which is conventionally driven by a machine crankshaft (not shown). The crankshaft coordinates and drives the push rods 12 to pivot the needle base 14 around the shaft 16 to reciprocate the compound needles 18. The push rods 20 pivot the sinker bar 22 to impart slight rotational movement of the trick-sinker 24 to coordinate its movement with the needles 18 and the guide bars 26, the movement of which is controlled by the guide bar rocker arm 28. In conventional manner, the guide bar rocker arm is driven by a suitable connection to the knitting machine crank shaft. The warp fabric 30 knit at the needles 18 is delivered to the take-up roll (not shown) by suitable rolls 32, 34, 36 and 38.

The combination trick-sinker 24 allows the knitting machine 10 to knit any fabric that can be knit on a tricot or raschel warp knitting machine but has eliminated the necessity for certain moving parts on such machine resulting in increased knitting machine speed up to at least 1500 courses/minutes. For example, the sinker and the latch wires of the raschel machine has been eliminated while the presser bar of the tricot machine has been eliminated. The trick-sinker 24 moves with the guide bars 26 and maintains a pre-determined relationship with the needles 18 and the sinker throat 40 of the thin plate members 41 to hold the knitted fabric 30 on the trick band 42 to allow the needles 18 to cast off the previously knit course but prevent the fabric 30 from moving with the needles 18 as they are retracted. Further, the trick band 42 of the trick-sinker 24 is so positioned to maintain an acute angle "A" of approximately 27 degrees with the vertical axis of the needles in order to align the knitted fabric 30 with the yarn from the back guide bar in order to maintain minimum stress and tension on the needles 18 to minimize breakage of needles and yarns.

Figure 5:
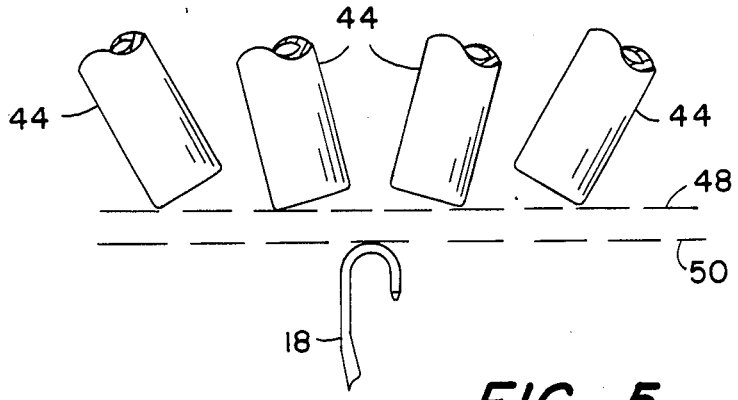
FIG. 5 is a schematic representation of the yarn guide tubes and their relation to the knitting needle.
Figure 8:
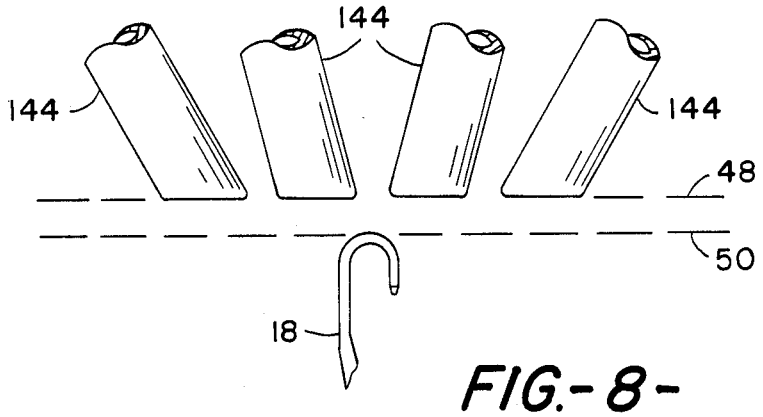
FIG. 8 is a modification of the guide tubes shown in FIG. 5.
Figure 7:
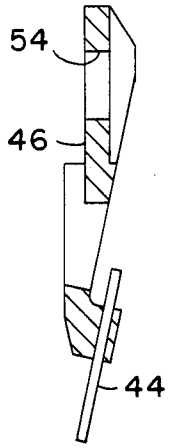
FIG. 7 is a view taken on line 7—7 of FIG. 6.

The operation of the knitting machine 10 is basically as described in U.S. Pat. No. 4,202,185, except that the knitting needles on the upward stroke do not project upward above the yarn guide tubes 44 secured in the yarn guide tube support plate 46. The guide tubes 4 provide control of the yarn so that the compound needles 18 only move up to a point closely adjacent the bottom of the tubes 4. By closely adjacent, it is meant that the distance between the line 48, denoting the bottom position of the tubes 44 and the line 50, denoting the top positions of the needle 18 is on the order of 15–20 thousandths of an inch (FIGS. 5 and 8). This distance will vary depending on the machine gauge, type of yarns and fabric construction.

Figure 6:
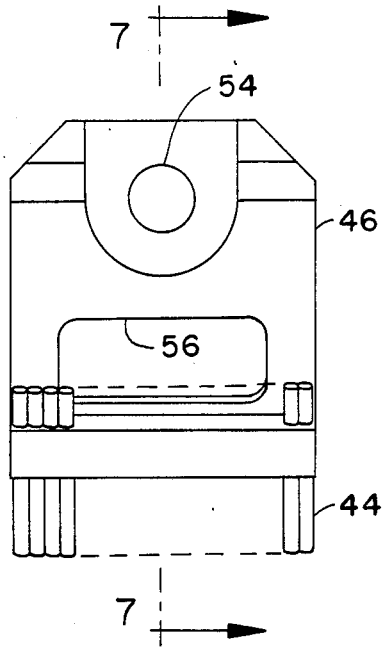
FIG. 6 is a front view of a guide tube support plate.

Each of the guide bars 26 support a plurality of yarn guide tube support plates 46 by suitable means such as screws 52 projected through the opening 54 and screwed into the plate 46. As shown in FIG. 6, the plate 46 holds a plurality of hollow yarn guide tubes 44 of suitable material such as stainless steel. The tubes 44 are pressed into the plate 46 and held therein by friction. An elongated opening 56 is provided in each plate 46 to provide visual and physical contact with the yarn and tubes in the plate 46 and/or adjacent plates 46.

In the preferred form of the invention as shown in FIGS. 1–7, the tube 44 is cut so that the bottom edge is parallel to the top edge which is perpendicular to the centerline of the tube (FIG. 5). If it is desired to provide closer control of the yarn passing through the tube 44, the tube can be formed so that the bottom edge of the tube commingles with the line 48 as shown in FIG. 8. This construction allows contact with the warp yarn at a point closer to the needle 18 than in the construction shown in FIG. 5.

As indicated in U.S. Pat. No. 4,202,185 increased operating speeds have been obtained by the use of the combined trick-sinker 24. Further, increases in speed are provided by the use of the tube guides since the use of same reduces the upward stroke of the needle 18 and the swing or stroke of the guard bar assembly 28 by approximately 65%. This reduction of the stroke of the needles and guide bar assembly allows the yarn to be directed closely adjacent to the needle thereby reducing the amount of yarn that is pulled through the guide bars from the warp beams on each knitting cycle. This action results in reduced scuffing of the yarn by the guide bars which in turn results in less machine stops due to yarn abrasion and/or breakage. Further, the guide tubes 44 require substantially less maintenance than the commonly used yarn guide member and reduces the amount of defects produced in the knitted fabric. Therefore, the disclosed invention provides a better fabric at a higher speed with reduced maintenance time and cost required.

Although I have described the preferred embodiment of my invention, I contemplate that changes may be made without departing from the scope or spirit of the invention and I desire to be limited only by the scope of the claims.

I claim:

1. A warp knitting machine comprising: a frame, yarn guide bars, a plurality of knitting needles operably associated with said yarn guide bars, said yarn guided bars having a plurality of yarn guide tubes mounted thereon, each of said yarn guide tubes being in contiguous relationship with the next adjacent yarn guide tubes, each of said yarn guide tubes having a yarn outlet located closely adjacent the top of said needles when said needles are in the uppermost position, means supplying warp yarn into each of said yarn guide tubes to said needles and trick-sinker means mounted on said frame adjacent said knitting needles to allow knit fabric to be cast off said needles without the fabric being pulled back by said needles and to guide the knit fabric away from said needles in substantial alignment with the warp yarn being supplied to one of said guide bars, said trick sinker means having a trick-sinker band on one side thereof to provide a planar guiding surface for the knit fabric, said trick-sinker means having a plurality of thin plate members connected thereto on the side thereof away from said trick-sinker band with one of said needles being located between two adjacent thin plate members, each of said thin plate members having a throat portion closely adjacent the top if said trick-sinker band cooperating with said knitting needles, said throat portion opening in a direction towards said trick-sinker band.

2. A warp knitting machine comprising: a frame, yarn guide bars, a plurality of knitting needles operably associated with said yarn guide bars, said yarn guide bars having a plurality of yarn guide tubes mounted thereon, each of said yarn guide tubes being in contiguous relationship with the next adjacent yarn guide tube, each of said yarn guide tubes having a yarn outlet located closely adjacent the top of said needles when said needles are in the uppermost position, means to supply warp through said guide tubes to said needles, means to cause said needles to knit the yarn supplied thereto into fabric and means operably associated with said frame to take-up the knit fabric.

3. The machine of claim 2 wherein said yarn guide bars each include a yarn tube support plate and a plurality of each of said yarn tubes being mounted in each of said plates.

4. The machine of claim 3 wherein said yarn guide plate has an elongated opening therethrough adjacent the yarn inlet end of each of said yarn guide tubes.

* * * * *

UNITED STATES PATENT AND TRADEMARK OFFICE

CERTIFICATE OF CORRECTION

PATENT NO. : 4,674,302

DATED : June 23, 1987

INVENTOR(S) : Bascum G. Lesley

It is certified that error appears in the above-identified patent and that said Letters Patent is hereby corrected as shown below:

Column 2, line 60, after yarn and before bars "guided" should be --guide--.

Column 2, line 3, number "4" should be --44--.

Column 2, line 6, num ber "4" should be --44--.

Column 3, line 13, "if" should be --of--.

Signed and Sealed this

Fifteenth Day of December, 1987

*Attest:*

DONALD J. QUIGG

*Attesting Officer*

*Commissioner of Patents and Trademarks*